United States Patent [19]

Yoerger

[11] Patent Number: 4,737,435

[45] Date of Patent: Apr. 12, 1988

[54] METHOD OF MODIFYING THE CHARGING PROPENSITY OF CARRIER PARTICLES FOR ELECTROSTATOGRAPHIC DEVELOPERS

[75] Inventor: William E. Yoerger, Rochester, N.Y.

[73] Assignee: Eastman Kodak Company, Rochester, N.Y.

[21] Appl. No.: 932,847

[22] Filed: Nov. 20, 1986

[51] Int. Cl.[4] ..... G03G 9/10

[52] U.S. Cl. ..... 430/137; 430/108

[58] Field of Search ..... 430/137, 108

[56] References Cited

U.S. PATENT DOCUMENTS 3,970,571 7/1976 Olson et al. ..... 430/137
4,076,857 2/1978 Kasper et al. ..... 430/103
4,478,925 10/1984 Miskinis ..... 430/137
4,546,060 10/1985 Miskinis et al. ..... 430/108

OTHER PUBLICATIONS

Kise, H. and Ogata, H., *Journal of Polymer Science: Polymer Chemistry,* Edition, vol. 21, (1983), pp. 3443-3451.

*Primary Examiner*—John L. Goodrow
*Attorney, Agent, or Firm*—David F. Janci

[57] ABSTRACT

The invention provides a method of modifying the triboelectric charging propensity of carrier particles coated with a fluorohydrocarbon polymer or copolymer. The method comprises dehydrofluorinating the polymer or copolymer by contacting the coated particles with a basic solution.

10 Claims, No Drawings

METHOD OF MODIFYING THE CHARGING PROPENSITY OF CARRIER PARTICLES FOR ELECTROSTATOGRAPHIC DEVELOPERS

FIELD OF THE INVENTION

This invention relates to the preparation of carrier particles intended to be mixed with toner particles to form a dry electrostatographic developer. More particularly, the invention concerns a method of modifying the triboelectric charging propensity of particles coated with a fluorohydrocarbon polymer or copolymer.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well known type of electrostatographic developer comprises a dry mixture of toner particles and carrier particles. Developers of this type are commonly employed in well known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface.

Many known dry, two-component electrostatographic developers contain thermoplastic toner particles and carrier particles that comprise a core material coated with a fluorohydrocarbon polymer or copolymer, such as poly(vinylidene fluoride) or poly(vinylidene fluoride-co-tetrafluoroethylene). See, for example, U.S. Pat. Nos. 4,546,060; 4,478,925; 4,076,857; and 3,970,571. Such polymeric fluorohydrocarbon carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles. All of these, and even more, purposes are well known in the art for polymeric fluorohydrocarbon carrier coatings.

However, while such carrier coatings can serve all of the above-noted purposes well, in some cases they do not adequately serve some or all of those purposes simultaneously. For example, in some developer compositions, polymeric fluorohydrocarbon carrier coatings can serve many of the above-noted purposes well, but, depending upon the nature of the toner particles and carrier core material desired to be included in the developer, such carrier coatings can cause the developer to acquire a triboelectric charge that is too high for optimum developer performance; i.e., the electrostatic latent image has difficulty pulling the toner particles away from the carrier particles. This is especially true in some positively charged developers (developers in which the toner particles triboelectrically acquire a positive charge, and the polymeric fluorohydrocarbon-coated carrier particles acquire a negative charge).

Therefore, it would be desirable to have a convenient method of modifying the triboelectric charging propensity of particles coated with a fluorohydrocarbon polymer or copolymer, so that the particles could be used as carriers that exhibit the beneficial properties noted above in electrographic developers but do not cause certain developers to acquire an undesirable magnitude of triboelectric charge. The present invention provides such a method.

SUMMARY OF THE INVENTION

The invention provides a method of modifying the triboelectric charging propensity of particles coated with a fluorohydrocarbon polymer or copolymer for use as carriers in electrostatographic development. The method comprises dehydrofluorinating the polymeric coating by contacting the coated particles with a basic solution.

This dehydrofluorination method is thought to have the effect of altering the chemical structure of some of the repeating units of the polymeric fluorohydrocarbons by removing some of the hydrogen and fluorine atoms from those units and adding a degree (or greater degree) of unsaturation to those units. While the exact structure of the dehydrofluorinated units is not known, it is hypothesized that the method produces a variety of unsaturated (vinylic-type and acetylenic-type) structural units in the polymers at and near the outer surface of the polymeric coatings. This change in chemical structure has the effect of repositioning the carrier particles toward the higher (more positive) end of the triboelectric series. Thus, the carriers will then have a tendency to triboelectrically charge less negatively, and they can then be employed instead of untreated polymeric fluorohydrocarbon-coated carriers in developers, for example, that would otherwise have acquired an undesirably high positive triboelectric charge (referring to the charge on the toner particles), to create, instead, a magnitude of positive developer charge in a lower, more acceptable range. In addition, the treated fluorohydrocarbon carrier coatings retain their capability of serving the other known purposes of polymeric fluorohydrocarbon carrier coatings, mentioned previously herein.

DESCRIPTION OF PREFERRED EMBODIMENTS

In carrying out the method of the invention, the coated carrier particles are brought into contact with a basic solution to effect the spontaneous dehydrofluorination reaction of the base with the polymeric fluorohydrocarbon coatings. This is simply accomplished by mixing the coated particles with the basic solution. Preferably, the mixture is continuously agitated during the reaction to assure that all surfaces of the coatings are contacted by the base and that the degree of reaction is fairly uniform at all surface areas of the coatings.

Dehydrofluorination of polymeric fluorohydrocarbons such as poly(vinylidene fluoride) by treatment with basic solutions is generally known in the chemical arts (although it is not known that such a treatment can be employed to beneficially alter the triboelectric charging propensity of carrier particles coated with such polymers), and it is known that when such treatments are applied to a polymeric fluorohydrocarbon in film form, the dehydrofluorination occurs mainly near the surface of the film that is contacted with the basic solution. See, for example, Kise, H. and Ogata, H., "Phase Transfer Catalysis in Dehydrofluorination of Poly(vinylidene Fluoride) by Aqueous Sodium Hydroxide Solutions", *Journal of Polymer Science: Polymer Chemistry Edition,*, Vol. 21 (1983) pp. 3443–3451. This holds true for the method of the present invention.

The depth of dehydrofluorination of the coatings can be varied somewhat by altering parameters of the process. For example, depth of the coating affected by the process can be increased somewhat by increased concentration of base in the treating solution or by increased time of treatment, but I have estimated that effective treatment will nevertheless be limited in practicality to a depth of about 5 nanometers, even when those parameters are increased. For purposes of some of the preferred embodiments, base concentrations from a trace to about 15 percent by weight of total solution were found to yield beneficial effects, depending upon the particular basic solution and polymeric coatings involved, but higher concentrations would also be useful and have no detrimental effect and would perhaps be preferred in some cases. Also, in some of the preferred embodiments a time of treatment of about 1 to 2 hours was found to be optimum (in consideration of the depth of polymeric coating material expected to wear away during the otherwise useful life of the carriers in preferred developers), but longer and shorter times can also be preferred in other cases, depending upon the nature of developer, type of development process, type of development apparatus, amount of useful carrier life needed, etc., that are involved in any particular instance. Furthermore, the *degree* of dehydrofluorination, i.e., the amount of dehydrofluorination of individual molecules of the polymers near the outer surfaces of the coatings (which is different from the *depth* of the treatment), can be varied by varying the temperature of the reactants. Altering the degree of dehydrofluorination, and, to some extent, the depth thereof, alters the degree of change in triboelectric charging propensity of the coated carrier particles; that is, the greater the depth and the higher the degree of dehydrofluorination, the more the particles are repositioned toward the higher (more positive, less negative) end of the triboelectric series. Thus, the optimum temperature to be used in any instance will depend upon the particular base and polymeric coating involved and the particular triboelectric charging propensity desired to be effected. Temperatures ranging from room temperature (about 21° to 28° C.) to a temperature just below the melting point of the particular polymeric coating involved were found to be useful in some preferred embodiments.

It was also noted that changing temperature could produce competing effects. Namely, increasing temperature generally tends to produce a higher degree of dehydrofluorination, but also the closer the temperature is to the melting point of the polymeric coating, the greater the tendency of individual molecules of the polymer to migrate within the coating. Since the dehydrofluorination occurs mainly near the surface of the coating, increased migration will allow molecules that have not been dehydrofluorinated (or that have been dehydrofluorinated to a lesser degree) to migrate toward the surface of the coating, thus tending to lessen the noticeable degree of effective dehydrofluorination near the surface. In fact, if, after the inventive process has been carried out (i.e., after the basic solution has been separated from the carrier particles), one heats the coated particles to a temperature above the melting point of the polymeric coating, the triboelectric charging propensity of the coated particles can eventually be brought back to very near the level of charging propensity exhibited before the inventive process was carried out. Therefore it is preferred to keep the temperature of the reactants significantly below the melting point of the polymeric fluorohydrocarbon coating, so as not to undo what one is trying to accomplish. It should be noted that fluorohydrocarbon coatings for carrier particles are already typically chosen such that their melting points are significantly higher than the temperatures likely to be encountered in electrostatographic development, so as not to scum the recording elements or development apparatus with such materials. Thus, no significant reversal of the desirable effects achieved by the present inventive process is likely to occur during normal developer use of the carrier particles after treatment in accordance with the invention.

Virtually any basic material or combination of basic materials can be employed in the inventive process. For example, good results have been achieved with metal hydroxides, such as KOH and NaOH; ammonium hydroxides, such as $NH_4OH$ and $(CH_3)_4NOH.5H_2O$; amine salts, such as $NaNH_2$, and other bases, such as $Na_2CO_3$.

It is preferred that the solution of base employed in the inventive process be an aqueous or alcoholic solution to aid in solvating and carrying away the hydrogen and fluorine ions removed from the polymeric coatings during the process. Alcoholic or aqueous/alcoholic solutions are most preferred, because of their superior ability to wet the entire surface of the polymeric fluorohydrocarbon coating during the treatment.

The method of the invention is applicable to any known or new carrier particles having polymeric fluorohydrocarbon coatings on their outer surfaces.

The carrier core materials can comprise conductive, non-conductive, magnetic, or non-magnetic materials. For example, carrier cores can comprise glass beads; crystals of inorganic salts such as sodium chloride, potassium chloride or aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,,060. In preferred embodiments of the invention specifically illustrated in the examples below, "soft" magnetic materials such as iron powders and "hard" magnetic materials such as strontium ferrites are employed.

Many polymeric fluorohydrocarbon compounds are known to serve as useful coatings on such carrier core materials, e.g., poly(vinylidene fluoride) or poly(vinylidene fluoride-co-tetrafluoroethylene), and many methods of applying such coatings in a continuous or discontinuous configuration of various uniform or non-uniform thicknesses are also well known. Some useful coating methods include solvent coating, spray application, plating, tumbling, shaking, fluidized bed coating, and melt coating, of which melt coating is usually preferred. See for example, U.S. Pat. Nos. 4,546,060; 4,478,925; and 4,233,387. In preferred embodiments of the invention specifically illustrated in the examples below, the coatings comprised poly(vinylidene fluoride) melt coated on the carrier core materials.

Carrier particles modified by the method of the present invention can be used in combination with virtually any type of toner particles known in the art to be useful in combination with carrier particles and with any of the sizes and size ratios known to be useful for such particles, to serve as dry electrostatographic developers in any of the well known dry electroscopic development schemes, e.g., cascade development or magnetic brush development.

The following examples are presented to further illustrate some preferred modes of practice of the method of the invention and to compare the triboelectric properties of carrier particles produced by the inventive method to those properties of similar carrier particles not treated in accordance with the invention.

In all of the examples, except Example 8, the starting carrier particles comprised strontium ferrite carrier cores melt-coated with poly(vinylidene fluoride). They were prepared by using a formulation comprising 1–3 percent by weight poly(vinylidene fluoride) and 97–99 percent by weight strontium ferrite particles. Two kilograms of the formulation were placed in a 4-liter wide-mouth glass jar and capped. The jar was vigorously shaken by hand and then roll-milled for 15 minutes at 140 revolutions per minute. The cap was then removed, and the jar was placed in a convection oven set at a temperature of 230° C. for 4 hours. After cooling to room temperature, the coated particles were passed through a sieve having 62-micrometer openings to break up any large agglomerates.

In all of the Examples the triboelectric properties of the carrier particles are indirectly determined by measuring the degree of charge imparted to toner particles with which they are mixed. Since in each example the intent is to measure toner charge imparted by carrier particles treated in accordance with the invention relative to toner charge imparted by similar carrier particles not treated in accordance with the invention, any known convenient method for measuring toner charge can be used. One such method comprises plating the toner by electrical bias onto the electrically insulating layer of a test element. This element is composed of, in sequence, a film support, an electrically conducting (i.e., ground) layer and the insulating layer. The amount of plating is controlled to produce a mid-range optical density of about 0.3. The test element containing the plated toner is connected via the ground layer to an electrometer. The plated toner is then rapidly removed by forced air, causing a flow of electric current to register in the electrometer as a charge, in microcoulombs. The registered charge is divided by the weight of the removed toner to obtain the toner charge in microcoulombs per gram (μc/g).

EXAMPLE 1

To 20.0 g of strontium ferrite core particles coated with 3 percent by weight poly(vinylidene fluoride) was added 20 ml of 2% alcoholic KOH (2.0 g KOH in 98 g isopropyl alcohol). The mixture was shaken on a shaker bath for 2 hours at room temperature (27°–28° C.). A control sample was also run containing only 20 ml of isopropyl alcohol and poly(vinylidene fluoride)-coated strontium ferrite carrier.

At the end of 2 hours, the samples were filtered, washed well with water and isopropyl alcohol, slurried with water, refiltered and washed with isopropyl alcohol and dried overnight in a vacuum oven at 55° C. To 3.6 g of the treated, dried carrier particles was added 0.4 g of a polyesteramide toner containing cyan pigment. The mixture was shaken for 2 minutes. The toner charge was measured, and the data obtained are listed in Table I.

TABLE I

| Sample | Toner Charge (μc/g) |
|---|---|
| Control | 20.7 |
| Treated w/ 2% alc. KOH | 12.0 |

The above data indicate that the inventive treatment of the coated carrier significantly reduced the electrical charge of the toner and coated carrier.

EXAMPLE 2

A series of tests were run in the manner of Example 1, but varying levels of alcoholic KOH were used to degrade the charge of the coated carrier. The results obtained are listed in Table II below. To 40 g of strontium ferrite carrier coated with 1 percent by weight poly(vinylidene fluoride) was added 40 ml of varying concentrations of a KOH-isopropanol solution. The mixtures were roll-milled in a glass container for 1 hour at room temperature (27°-28° C.), after which the samples were washed as described in Example 1 and dried at 55° C.

1.74 g samples of each of the above treated and dried carriers were placed in glass vials with 0.26 g of a polyester toner containing magenta pigment. The vials were shaken for 3 minutes. The toner charges were measured and are listed in Table II.

TABLE II

| % KOH in Alcohol | Toner Charge (μc/g) |
|---|---|
| 0 | 55.3 |
| 0.1 | 40.8 |
| 0.2 | 37.1 |
| 0.5 | 35.7 |
| 1.0 | 33.1 |
| 2.0 | 30.7 |

The data in Table II indicate that increased KOH concentration produced increased depth of dehydrofluorination and consequently decreased charge.

EXAMPLE 3

This example illustrates that the subject dehydrofluorination treatment reduces the fluorine atoms only near the surface of the coating, and that if the degraded material is heated above its melting point (about 160°-165° C.), fresh poly(vinylidene fluoride) from the bulk of the resin coating is freed and migrates to the surface, counteracting the charge-lowering effect of the inventive method.

Samples of 2% alcoholic KOH-treated carrier (1 percent poly(vinylidene fluoride) on strontium ferrite core) were heated for 2 hours at various temperatures. Then 0.52 g of a polyester toner was mixed with 3.48 g of each treated carrier, and the toner charge levels were measured to yield the data in Table III.

TABLE III

| Treatment Temperature, °C. | Toner charge (μc/g) |
|---|---|
| Untreated control | 20.8 |
| 50 | 13.7 |
| 70 | 14.4 |
| 90 | 15.6 |
| 110 | 15.8 |
| 150 | 16.9 |
| 170 | 20.0 |
| 210 | 20.4 |

EXAMPLE 4

The dehydrofluorination reaction can be forced to a greater degree merely by heating the materials. To illustrate this, 70.0 g samples of strontium ferrite carrier core comprising 3 percent by weight poly(vinylidene fluoride) as an overcoat, were mixed with 70.0 ml of 2% KOH in isopropanol and heated in glass containers on a heated roll mill at various temperatures for 2 hours. The samples were then filtered and washed as described in Example 1, and 1.74 g samples were placed in vials with 0.26 g of polyester toner and shaken for 3 minutes. The toner charges were then measured and are noted in Table IV.

TABLE IV

| Treatment Temperature, °C. | Toner Charge (μc/g) |
|---|---|
| Untreated control | 28.2 |
| Room temperature ≈21 | 22.4 |
| 38 | 21.4 |
| 49 | 18.3 |
| 55 | 15.9 |

EXAMPLE 5

Another base is illustrated to be a useful dehydrofluorination agent in this example. To a 60.0 g sample of strontium ferrite particles coated with 3% poly(vinylidene fluoride) was added 3.12 g of tetramethylammonium hydroxide pentahydrate dissolved in 10 ml of methanol and diluted with 50 ml of isopropanol. The mixture was roll milled in a glass container for 2 hours at 50° C. after which the particles were filtered, reslurried with methyl alcohol, refiltered and rewashed with methyl alcohol and dried in a 55° C. vacuum oven, followed by evaluation of the treated sample and an untreated control with polyester toner as in Example 2 to yield the data in Table V.

TABLE V

| Sample | Toner Charge (μc/g) |
|---|---|
| Control | 27.0 |
| $(CH_3)_4NOH.5H_2O$—treated | 9.8 |

EXAMPLE 6

Sodamide and ammonium hydroxide were used as dehydrofluorination agents as follows:

To 40 g samples of strontium ferrite carrier coated with 3 percent poly(vinylidene fluoride), were added 60 ml of one of the agents shown in Table VI. The samples were rolled in glass containers for two hours at room temperature (27°-28° C.) and then filtered and washed with methanol or methanol/water and dried in a 55° C. vacuum oven for several hours. The dried materials were then evaluated with polyester toner as in Example 2 to yield the data in Table VI.

TABLE VI

| Treating Agent | Toner Charge (μc/g) |
|---|---|
| Untreated control | 27.0 |
| 15% $NH_4OH$ in methanol/$H_2O$, 1/1 | 12.0 |
| 15% $NH_4OH$ in isopropanol/$H_2O$, 1/1 | 9.9 |
| 4% $NaNH_2$ in methanol | 16.1 |

EXAMPLE 7

This example illustrates that aqueous treating solutions can also be used, although they are generally les efficient than alcoholic or aqueous/alcholic solutions.

40 g samples of strontium ferrite core particles coated with 1 percent by weight poly(vinylidene fluoride) were treated with 60 ml of various solutions (indicated in Table VII) at room temperature (27°–28° C.) for 2 hours. The particles were then filtered on glass fiber filter, washed 5 times on the filter with distilled water, reslurried with 250 ml distilled water, refiltered, and dried at 50°–55° C. 0.13 g portions of a magenta-colored polyester toner were added to 0.87 g samples of the treated carriers and an untreated control in glass vials. The vials were shaken for 3 minutes, and the toner charge was measured for each sample. Results are given in Table VII.

TABLE VII

| Treating Solution | Toner Charge (μc/g) |
|---|---|
| Untreated control | 68.2 |
| 2% Alcoholic KOH | 41.7 |
| 4% KOH, Aqueous | 45.6 |
| 8% KOH, Aqueous | 37.6 |

EXAMPLE 8

This example illustrates the applicability of the inventive method to carriers comprising a different core material.

To 50 g of poly(vinylidene fluoride)-coated porous, oxidized iron carrier was added 50 ml of 2% isopropanol/KOH in a 75 ml glass bottle, which was then rolled for two hours at room temperature (27°–28° C.). The carrier was then filtered, rinsed with 100 ml methanol, reslurried 3 times with 100 ml of 80/20 $H_2O$/methanol, decanted and then filtered and washed with 100 ml methanol and dried for several hours in a 55° C. vacuum oven.

29.16 g samples of treated and untreated carrier were then mixed with 0.84 g of crosslinked poly(styrene-co-butylacrylate) toner, the samples were shaken, and the toner charges were measured. Results are presented in Table VIII.

TABLE VIII

| Carrier | Toner Charge (μc/g) |
|---|---|
| Control | 30.6 |
| KOH-treated | 14.7 |

The inventive method has been described in detail, with particular reference to certain preferred modes of practice thereof, but it should be understood that variations and modifications can be effected within the spirit and scope of the invention.

What is claimed is:

1. A method of modifying the triboelectric charging propensity of particles coated with a fluorohydrocarbon polymer or copolymer for use as carriers in electrostatographic development, comprising dehydrofluorinating the polymer or copolymer by contacting the coated particles with a basic solution.

2. The method of claim 1, wherein the fluorohydrocarbon polymer is poly(vinylidene fluoride).

3. The method of claim 1, wherein the basic solution is an aqueous or alcoholic solution.

4. The method of claim 1, wherein the basic solution comprises potassium hydroxide dissolved in an alcohol.

5. The method of claim 1, wherein the basic solution comprises ammonium hydroxide in water and an alcohol.

6. The method of claim 1, wherein the coated particles comprise metallic core material coated with the fluorohydrocarbon polymer or copolymer.

7. The method of claim 6, wherein the metallic core material is ferromagnetic.

8. The method of claim 6, wherein the metallic core material comprises a ferrite.

9. The method of claim 6, wherein the metallic core material comprises a strontium ferrite.

10. The method of claim 1, wherein the dehydrofluorinating is carried out while heating the coated particles and the basic solution to a temperature less than the melting point of the fluorohydrocarbon polymer or copolymer.

* * * * *